US006402340B1

(12) United States Patent
Sharrah et al.

(10) Patent No.: US 6,402,340 B1
(45) Date of Patent: Jun. 11, 2002

(54) STYLUS FLASHLIGHT AND METHOD FOR MAKING SAME

(75) Inventors: Raymond L. Sharrah, Norristown; Charles W. Craft, Lansdale, both of PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 09/511,876

(22) Filed: Feb. 25, 2000

(51) Int. Cl.[7] ..... F21S 4/04

(52) U.S. Cl. ..... 362/206; 362/202; 362/118; 362/800

(58) Field of Search ..... 362/206, 118, 362/202, 800

(56) References Cited

U.S. PATENT DOCUMENTS

| | | | | |
|---|---|---|---|---|
| 4,841,417 A | * | 6/1989 | Maglica et al. | 362/206 |
| 5,131,775 A | * | 7/1992 | Chen | 401/195 |
| 5,197,796 A | * | 3/1993 | Moore | 362/202 |
| 5,642,932 A | | 7/1997 | Matthews | |

OTHER PUBLICATIONS

Eveready Lighting Products, Catalog, Spring 1983, 24 Pages.

Promo–lite, Brochure, undated, 4 pages.

* cited by examiner

*Primary Examiner*—Sandra O'Shea
*Assistant Examiner*—Ali Alavi
(74) *Attorney, Agent, or Firm*—Dann, Dorfman, Herrell and Skillman, P.C.

(57) ABSTRACT

A flashlight comprises an electrically-conductive cylindrical housing having a reduced inner diameter portion, for example, a tapered portion, and a hole at a forward end thereof with a solid state light source projecting through the hole at the forward end thereof and a tail cap attached to the housing at a rearward end thereof. A switch in the tail cap selectively connects the solid state light source and at least one battery in the housing in circuit through the housing for causing the solid state light source to produce light. The light source makes electrical contact with the housing at a contact area at which an insulating coating has been removed. The housing of the flashlight is formed by forming a reduced inner diameter portion in a cylindrical housing tube having an insulating coating and removing the insulating coating from the inner surface of the reduced inner diameter portion of the housing to provide the contact area.

51 Claims, 4 Drawing Sheets

STYLUS FLASHLIGHT AND METHOD FOR MAKING SAME

The present invention relates to a flashlight and to a method for making same.

Flashlights are available in a wide variety of shapes and sizes, and tailored to a particular use or situation. However, two desires that continue to indicate the need for improved flashlights include the desire for small flashlights and longer useful life. For example, there is a desire for a flashlight that is of a size and shape to conveniently fit in a pocket, e.g., a shirt pocket. In addition, there is a desire for a flashlight that has a bright beam and that operates for a long time before needing to replace or recharge the battery. Also, consumers also want such flashlights to be durable and available at a reasonable cost.

Prior art pocket lights such as a typical pen-shaped light typically are about 1.3 to 2 cm in diameter and are quite heavy, principally due to the size and weight of the type AA (about 1.4 cm diameter) or type AAA (about 1 cm diameter) batteries therein. It would be desirable to have a flashlight of about 1 cm or less in diameter, which is closer to the diameter of typical pens and pencils also kept in a person's pocket. A further advantage of a smaller-diameter flashlight is the ability to shine the light into small spaces.

The desire for a small-diameter flashlight makes the inclusion of complex internal current-carrying conductors undesirable because they tend to increase the diameter of the light, as well as adding cost thereto, i.e. cost for material, cost for fabrication of the internal parts, and added cost for assembly of the flashlight.

Prior art flashlights typically employ filament-type lamps that have a filament that is electrically heated to glow to produce light, wherein the filament is suspended between supports. Typical filaments tend to be fragile, and often more so when they are heated to glowing. As a filament is used, the filament material may thin or become brittle, thereby increasing its susceptibility to breakage. Even high-light-output lamps such as halogen and xenon lamps employ a heated filament, albeit a more efficient light producer than is a conventional incandescent lamp filament. A solid-state light source, such as a light-emitting diode (LED), for example, does not have a heated filament and so is not subject to the disadvantages associated with lamp filaments, and such LEDs are now available with sufficiently high light output as to be suitable for the light source for a flashlight.

Accordingly, there is a need for a flashlight that can have a small diameter and that has a housing that can be made at a reasonable cost, To this end, the flashlight of the present invention comprises a cylindrical electrically conductive housing having a reduced inner diameter portion and a hole at a forward end thereof. A solid state light source is in the housing and projects through the hole at the forward end thereof and at least one battery is in the housing. A tail cap is attached to the housing at a rearward end thereof, and a switch selectively connects the solid state light source and the at least one battery in circuit for causing the solid state light source to produce light, the circuit including the electrically conductive housing.

According to another aspect of the invention, a method of making a housing comprises:

providing an elongated hollow member of electrically conductive material having an insulating coating thereon;

forming a reduced inner diameter portion in the elongated hollow member; and removing the insulating coating from an inner surface of the elongated hollow member in the region of the reduced inner diameter portion thereof.

BRIEF DESCRIPTION OF THE DRAWING

The detailed description of the preferred embodiments of the present invention will be more easily and better understood when read in conjunction with the FIGURES of the Drawing which include.

Figure 1:
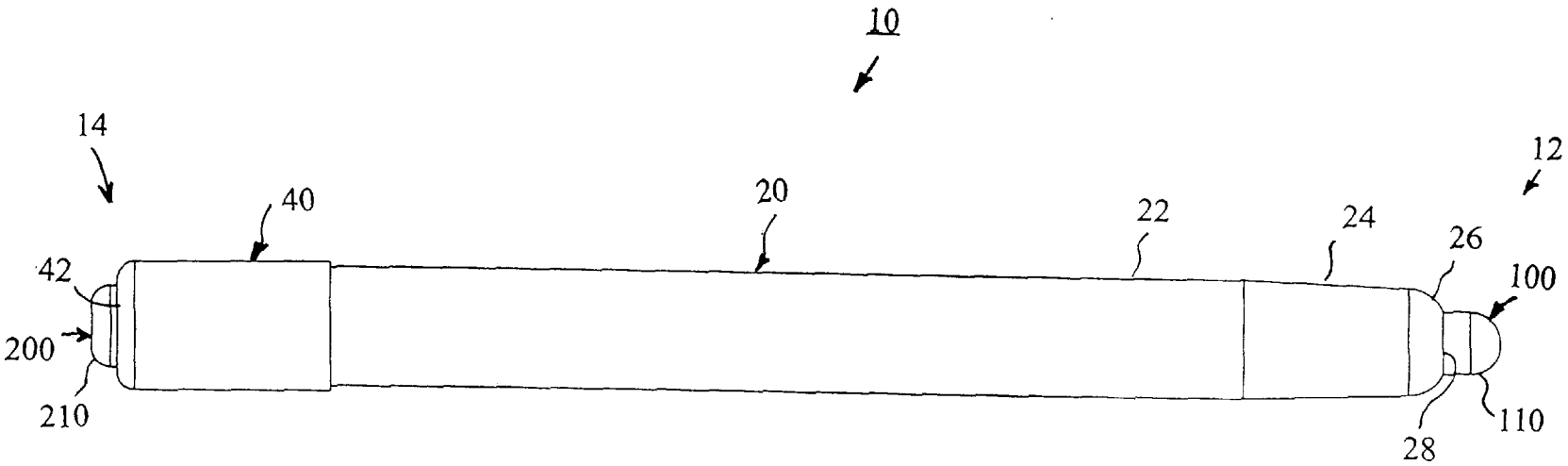
FIG. 1 is a side view of an exemplary embodiment of a flashlight in accordance with the present invention.

In the Drawing, where an element or feature is shown in more than one drawing figure, the same alphanumeric designation is used to designate such element or feature in each figure, and where a closely related or modified element is shown in a figure, the same alphanumerical designation primed may be used to designate the modified element or feature.

DESCRIPTION OF THE PREFERRED EMBODIMENT

FIG. 1 is a side view of an exemplary embodiment of a flashlight 10 in accordance with the present invention. Flashlight 10 has a forward or head end 12 at which light is produced by a light source assembly 100 including a solid-state light source 110 such as an LED, and a rearward or tail end 14 at which is a tail switch assembly 200 including a pushbutton 210. Hollow cylindrical housing 20 of flashlight 10 has an elongated hollow cylindrical portion 22 and a hollow reduced inner diameter portion 24, for example, a tapered portion 24, proximate head end 12. Housing 20 is formed into a generally rounded forward end 26 at head end 12 and has a circular hole therein through which solid state light source 110 of light source assembly 100 projects in a forward direction. Cylindrical tail cap 40 overlies cylindrical housing 20 at the tail end 14 of flashlight 10 and has a circular hole 42 therein through which pushbutton 210 of tail switch assembly 200 projects in a rearward direction. Light source 100 is turned on by either depressing pushbutton 210 or by rotating tail cap 40 further onto housing 20.

Figure 2:
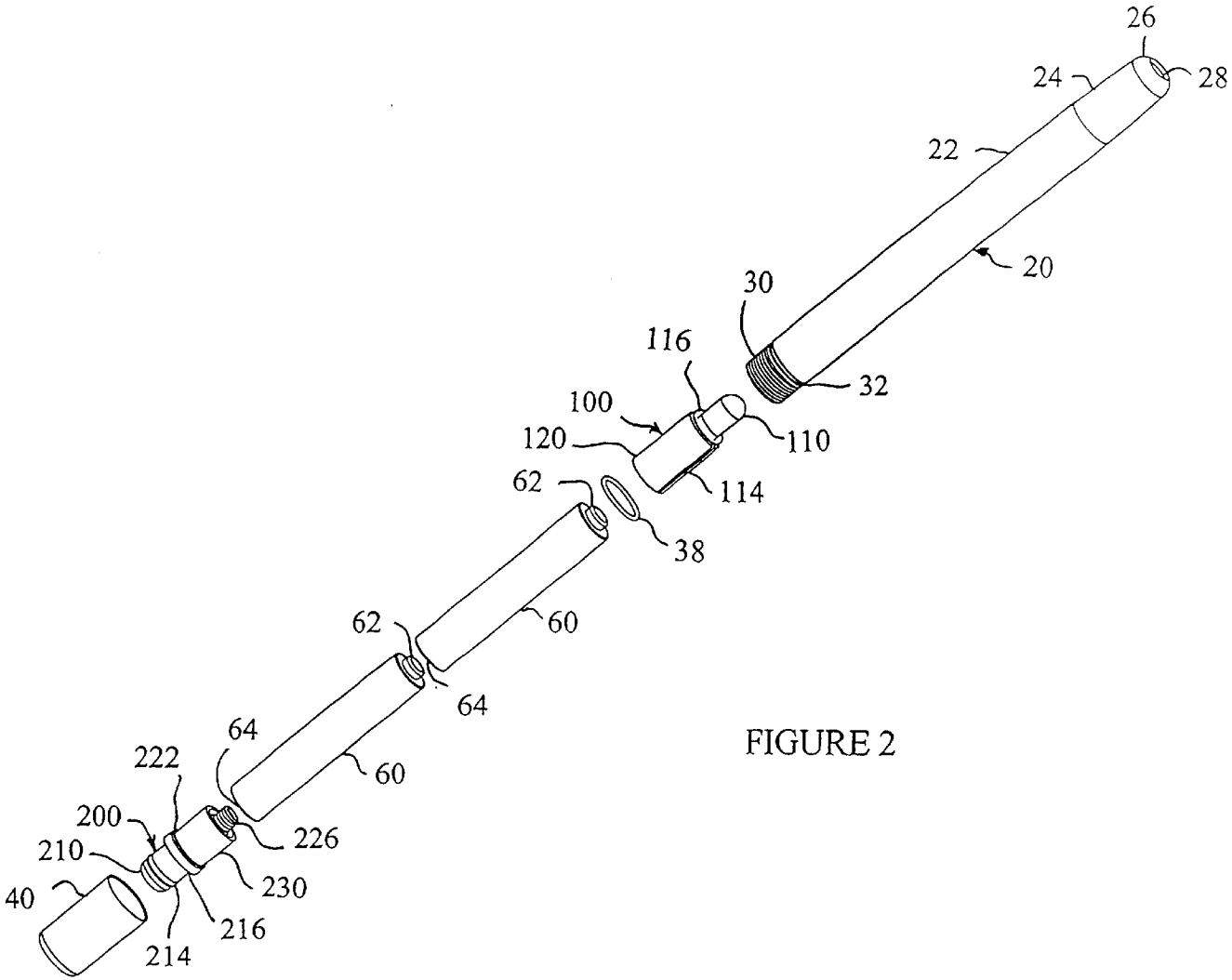
FIG. 2 is an exploded perspective view of the flashlight of FIG. 1.

FIG. 2 is an exploded perspective view of the flashlight 10 of FIG. 1 illustrating the external and internal components thereof. Hollow cylindrical housing 20 includes an elongated hollow cylindrical portion 22 and a hollow reduced inner diameter portion 24, for example, a tapered portion 24, proximate rounded forward end 26 thereof in which is formed circular hole 28 through which the light-emitting lens of light source 110 projects. Tubular housing 20 includes external threads 30 at the rearward end thereof for engaging the internal threads (not visible in FIG. 2) on the inner surface of tail cap 40. Housing 20 has a circumferential groove 32 forward of threads 30 for receiving a resilient O-ring 38 therein that provides a water-resistant seal between housing 20 and tail cap 40.

Internal components that slip inside the hollow cylindrical housing 20 include light source assembly 100 and batteries 60. Light source assembly 100 includes solid state light source 110 mounted in cylindrical base 120 with its electrical lead 114 in a longitudinal slot therein. Resilient O-ring 116 fits over light source 110 to provide a water-resistant seal between light source 110 and housing 20 when light source assembly is installed forward within housing 20 with O-ring 116 bearing against the internal forward surface thereof proximate circular hole 28. Batteries 60 each include a positive terminal 62 and a negative terminal 64 and are connected in series to provide a source of electrical energy for energizing light source 110 to cause it to produce light. Typically, two batteries 60 (as illustrated) or three batteries 60 are employed, although a greater or lesser number could be employed by appropriately lengthening or shortening the length of housing 20. Preferably, batteries 60 are of the type AAAA alkaline cells which provide a voltage of about 1.2–1.5 volts and have a diameter of about 0.8 cm or less. As a result, flashlight 10 has an outer diameter of only about 1 cm (about 0.38 inch), and is 12.6 cm (about 4.95 inches) long for a two-battery flashlight and 16.8 cm (about 6.6 inches) long for a three-battery flashlight, and operates for about 10 hours or more on a set of batteries.

The small outer diameter of flashlight 10 advantageously permits flashlight 10 to be "pocket-sized" in that it is of a size that permits it to be carried in a pocket or pouch, if so desired, although it need not be.

At the rearward or tail end 14 of flashlight 10, tail switch assembly fits inside the central cavity of tail cap 40 with circular pushbutton 210 of tail switch assembly 200 projecting through circular hole 42 in the rearward end thereof. Resilient O-ring 214 on pushbutton 210 provides a water-resistant seal between pushbutton 210 and tail cap 40 when pushbutton 210 is installed therein with O-ring 214 bearing against the interior surface of tail cap 40 proximate circular hole 42 therein.

Selective electrical connection between negative terminal 64 of rearward battery 60 and the rearward end metal housing 20 is made via outwardly extending circular metal flange 222 which is electrically connected to coil spring 226. When push button 210 is depressed or when tail cap 40 is screwed further onto threads 30 of housing 20 moving tail switch assembly 200 forward relative to housing 20, metal flange 222 comes into electrical contact with the rearward annular surface of cylindrical housing 20 thereby to complete an electrical circuit including batteries 60 and light source 110, to the end of applying electrical potential to solid state light source 110 to cause it to emit light.

Figure 3:
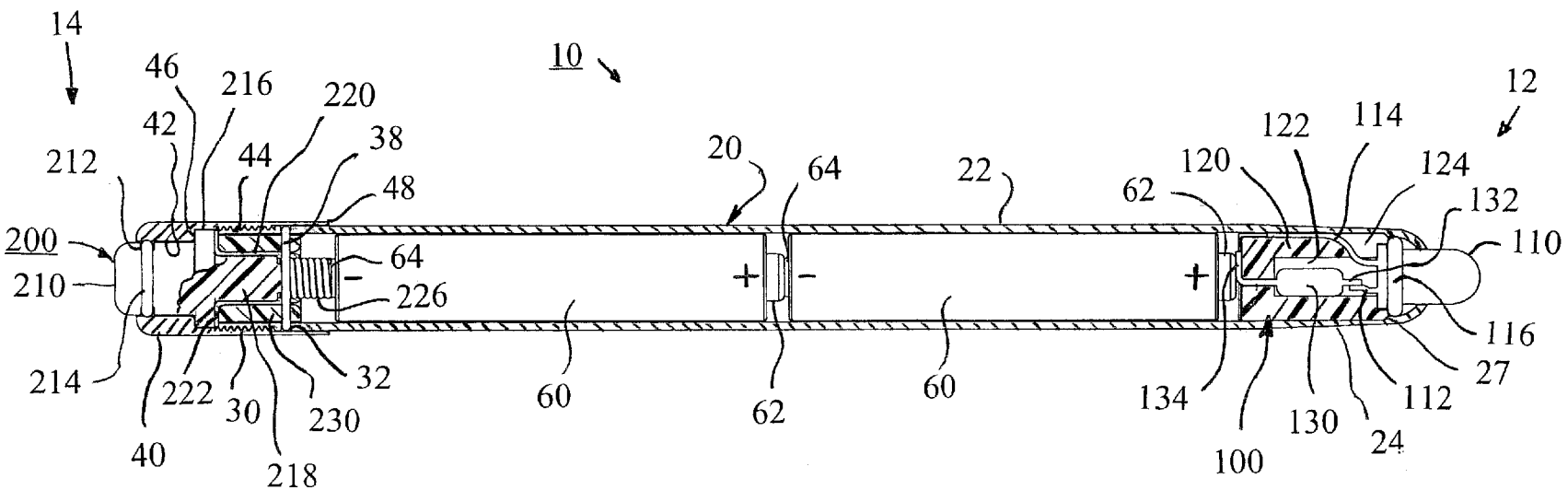
FIG. 3 is a side cross-sectional view of the flashlight of FIG. 1.

FIG. 3 is a side cross-sectional view of the flashlight 10 of FIG. 1 showing the relative positions of the external and internal components thereof when tail cap 40 is screwed onto threads 30 of housing 20 sufficiently to cause metal flange 222 to contact the rear end of housing 20, thereby to energize light source 110 to produce light as described above. Switch assembly 200 is free to move axially forward and rearward within housing 20 and tail cap 40, and does so under the urging of coil spring 226 and pressure applied to pushbutton 210. Unscrewing tail cap 40 moves tail cap 40 rearward and allows switch assembly 200 therein to also move rearward under the urging of spring 226, thereby breaking contact between metal flange 222 and the rear end of housing 20 and breaking the electrical circuit including batteries 60 and LED light source 110, thereby to de-energize light source 110 to stop the producing of light. Momentary switching (or blinking) action obtains from depressing/releasing pushbutton 210 when tail cap 40 is unscrewed slightly from the position illustrated in FIG. 3 and continuous on/off operation obtains by screwing tail cap 40 onto/away from housing 20 sufficiently to cause light assembly 110 to produce and not produce light.

Coil spring 226 urges batteries 60 forward causing their respective positive terminals 62 and negative terminals 64 to come into electrical contact and complete an electrical circuit between metal coil spring 226 and electrical lead 134 of light source assembly 100. In assembling flashlight 10, light source assembly 100 is inserted into housing 20 and is pushed forward causing electrical lead 114 thereof to come into physical and electrical contact with the interior surface of the wall of metal housing 20, e.g., by abutting housing 20 at shoulder 27. Light source assembly 100 is inserted sufficiently far forward to cause O-ring 60 to provide a seal between light source 110 and the interior surface of housing 20 proximate circular hole 28 therethrough Light source assembly 100 is preferably a press fit into the tapered portion 24 of housing 20 owing to the contact of lead 134 and cylindrical body 130 with the interior surface of tapered portion 24.

Light source assembly 100 includes a solid state light source 110, preferably a light-emitting diode (LED). LEDs are available to emit light of one of a variety of colors, e.g., white, red, blue, amber, or green, and have extremely long expected lifetimes, e.g., 100,000 hours. Light source assembly 100 includes an insulating cylindrical body 120 having a central cavity 122 therein and a longitudinal slot 124 axially along one external surface thereof. LED light source 110 mounts into cylindrical body 120 with one electrical lead 114 thereof lying in slot 124 so as to come into physical and electrical contact with the interior surface of tapered portion 24 of cylindrical housing 20 and with the other electrical lead 112 thereof connected to lead 132 of electrical device 130 within central cavity 122 of cylindrical body 120. The other electrical lead 134 of electrical device 130 projects rearwardly out of the central cavity 122 of cylindrical body 120 to come into electrical contact with the positive terminal 62 of forward battery 60, thereby to complete an electrical circuit between battery 60 and metal housing 20 through LED light source 110. Electrical body 120 is preferably a rigid dielectric material such as a moldable plastic or ceramic, such as a glass-filled PBT plastic.

Electrical device 130 is preferably an electrical resistor with one of its leads 134 contacting battery 60 and the other of its leads 132 connected to lead 112 of LED light source 110 to limit the current that flows therethrough, thereby to extend the life of LED light source 110 and of batteries 60. Resistor 130 is preferably a carbon film resistor, and other types of resistors can be utilized. If a reverse potential were to be applied to LED light source 110, as could occur if batteries 60 were installed backwards, the diode action of LED light source 110 and resistor 130 prevent excess current flow in LED light source 110 that might otherwise cause the light-emitting diode therein to become degraded, damaged or burned out.

Tail switch assembly 200 is positioned within tail cap 40 at the rearward end 14 of flashlight 10. Tail switch assembly 200 includes a generally cylindrical pushbutton 210 of insulating plastic that includes a rearward cylindrical section that projects through hole 42 of tail cap 40 and has a circumferential groove 212 in which resilient O-ring 214 resides to provide a water resistant seal between pushbutton 210 and tail cap 40 proximate hole 42 therein. Tail cap 40 includes a cylindrical skirt 48 extending forwardly from internal threads 44 therein and extending along housing 20. Tail cap skirt 48 provides an inner surface for sealing tail cap 40 against O-ring 38, and also provides a greater length to tail cap 40 thereby making it easier to grip for rotating tail cap 40 relative to housing 20 to turn flashlight 10 on and off.

Pushbutton 210 also includes a central cylindrical section having a greater diameter than the rearward section thereof to provide an outwardly extending circular flange 216 that engages a corresponding shoulder 46 of tail cap 40 to retain pushbutton 210 captive therein. Forward cylindrical body section 218 of pushbutton 210 is preferably of lesser diameter than the rearward section and circular flange 216 thereof to receive a cylindrical metal ferrule 220 thereon. Metal ferrule 220 receives metal coil spring 226 in the forward cylindrical section thereof and includes circular flange 222 extending radially outward therefrom. Radial flange 222 comes into contact with the rearward end of housing 20 when pushbutton 210 is depressed or when tail cap 40 is rotated clockwise with respect to housing 20 to advance axially forward thereon due to the engagement of the external threads 30 on the external surface of housing 20 and the internal threads 44 of tail cap 40. Insulating plastic cylindrical ferrule 230 surrounds metal ferrule 220 and centers tail switch assembly within the central longitudinal cylindrical cavity of housing 20. Preferably, metal ferrule 220 is a tight fit over cylindrical body section 218 of pushbutton 210 and plastic ferrule 230 is a tight fit over metal ferrule 220 for holding together with a slight press fit, without need for adhesive or other fastening means.

Alternatively, body portion 218, metal ferrule 220 and insulating ferrule 230 may each be tapered slightly for a snug fit when slipped over each other, and metal ferrule 220 may be split axially so as to more easily be expanded and compressed for assembly over body portion 218 and securing thereon by ferrule 230. Metal ferrule 220 is preferably brass, but may be copper, aluminum, steel or other formable metal. Coil spring 226 is preferably stainless steel, but may be of steel, beryllium copper or other spring-like metal.

Housing 20 and tail cap 40 are metal so as to provide an electrically conductive path along the length of flashlight 10, and are preferably of aluminum, and more preferably of 6000 series tempered aircraft aluminum. Housing 20 and tail cap 40 are preferably coated for aesthetics as well as for preventing oxidation of the aluminum metal, and preferably are coated with a durable material such as an anodized finish, which is available in several attractive colors such as black, silver, gold, red, blue and so forth. While an anodized finish is hard and durable, it is not electrically conductive and so, absent the arrangement of the present invention, interferes with completing an electrical circuit including batteries 60 and light source 110 through housing 20.

Figure 4:
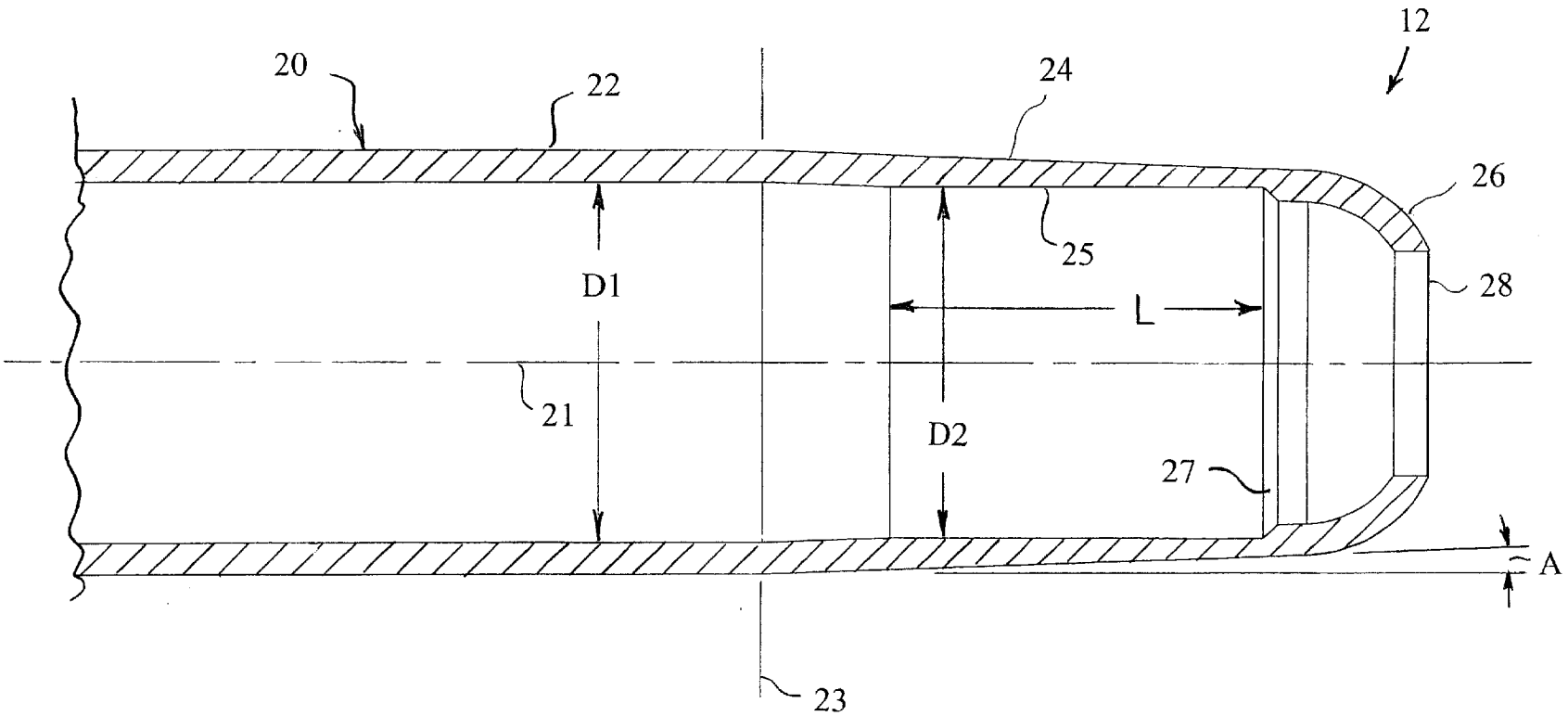
FIG. 4 is an enlarged side cross-sectional view of a portion of the barrel of the flashlight of FIG. 1.

To the end of providing one or more electrical connections to housing 20, FIG. 4 is an enlarged side cross-sectional view of a forward portion of housing 20 of the flashlight 10 of FIG. 1. Housing 20 is preferably formed from a cylindrical aluminum tube or tube stock, such as an extruded cylindrical tube, preferably an aluminum tube having an outer diameter of about 1 cm or less, as follows. An length of aluminum tube is cut to a length slightly longer than the axial length of housing 20 and one end thereof forward of break line 23 is roll formed, preferably cold roll formed, so as to have a slight narrowing taper, thereby forming tapered portion 24 of housing 20 having an inner diameter that is less than the inner diameter of the remainder of housing 20 proximate the forward or head end 12 thereof. A taper angle A of less than about 5° from the longitudinal center axis 21 is desirable. In fact, for an about 1 cm diameter tube, a taper of about 2° is preferred. Housing 20 is further roll formed at the head end 12 of tapered portion 24 to form a rounded forward end 26 having a narrowed-diameter opening therein that is trimmed, such as by drilling or boring, to provide circular hole 28 coaxially with housing centerline 21. The roll forming of tapered portion 24 and rounded end 26 may be performed in a single operation. Housing 20 is coated with the preferred anodized or other finish, preferably before the forming and subsequent operations.

Because the preferred anodized finish is not electrically conductive, it must be removed at locations on housing 20 at which electrical connection is to be made. To this end, the reduced inner diameter tapered forward portion 24 of housing 20 provides a particular advantage, it being noted that the rolling tapers both the outer and inner surfaces of tapered portion 24. Because the aluminum tube is tapered only at its forward end, the interior diameter of housing 20 is of uniform inner diameter D1 over its entire length except at tapered portion 24 forward of break line 23 where it has a reduced diameter. Thus, a reamer or boring tool of diameter D2 greater than the inner diameter of the reduced inner diameter portion 24 and less than the inner diameter D1 of the remainder of housing 20 will remove the insulating coating only in the reduced inner diameter portion 24 of housing 20 and form a ridge or shoulder 27 at the forward end thereof A housing 20 so formed may have a cylindrical outer shape or other outer shape, as is desired. The clearance reamer or other boring tool is inserted into the interior of housing 20 from the tail end 14 thereof and through cylindrical portion 22 thereof and includes a cutting head that cuts a bore of diameter D2 that is less than the inner diameter D1 of cylindrical portion 22, and so does not cut within portion 22 and remove the electrically insulating coating therefrom, and may include a non-cutting guide of a diameter greater than D2, but less than D1, rearward of its cutting head for centering the boring tool substantially coaxially along centerline 21 of housing 20.

As the clearance reamer or boring tool advances forwardly into tapered portion 24, it cuts a cylindrical bore 25 of diameter D2 interior to tapered portion 24, thereby cutting through the non-conductive anodized coating to expose the conductive aluminum metal of housing 20, to provide a contact area to which electrical lead 114 of light source assembly 100 makes electrical contact when light source assembly 100 is inserted into housing 20 and advanced forwardly therein until light source 110 abuts, i.e. is proximate to, shoulder 27 and extends through hole 28. The diameter D2 and length L of bore 25 are selected to provide sufficient exposed aluminum contact surface in bore 25 while leaving sufficient thickness in the forward end of the wall of tapered portion 24 of housing 20. Typically, housing 20 has an outer diameter of about 0.95 cm, an inner diameter of about 0.80 cm, and bore 25 has a diameter D2 of about 0.79 cm and a length L of about 0.9–1.0 cm.

The rearward end 14 of housing 20 has external threads 30 formed on the outer surface thereof, such as by machining or cold forming, and the anodized finish is removed from rearward end of housing 20, such as by machining or grinding, so as to expose the metal of housing 20 to provide a location to which circular flange 222 of metal ferrule 220 can make electrical contact.

Alternatively, the boring tool utilized to cut bore 25 in tapered portion 24 may also include a second cutting head of lesser diameter located forward of the cutting head that cuts bore 25, wherein the second more-forward cutting head is utilized to bore hole 28 in a single operation with the cutting of bore 25.

While housing 20 has been described in terms of tapered portion 24 of housing 20 having an interior surface that is tapered so that a reamer or boring tool may be utilized to remove the electrically insulating anodize coating therefrom, any form of housing 20 having a reduced inner diameter portion 24 near the forward end 12 thereof that a reamer or boring tool or other like tool may be utilized to remove the electrically insulating coating therefrom. Thus, a housing having a reduced inner diameter portion 24 is satisfactory irrespective of whether or not the exterior surface of the reduced inner diameter portion 24 of housing 20 is of the same, smaller or larger outer diameter than is the rest of housing 20 and irrespective of whether the shape of the outer surface of reduced inner diameter portion 24 of housing 20 is the same as or different from the shape defined by the inner surface of reduced inner diameter portion 24 thereof.

Accordingly, housing 20 may be formed by thin-wall impact extrusion wherein a blank or preform of metal such as aluminum is deep drawn to form a cylindrical housing 20 having a cylindrical interior bore that is of a given diameter except at the forward end thereof at which it has a reduced inner diameter. The reduced inner diameter portion may be a tapered interior shape or may be a smaller diameter cylindrical bore, for example. In impact extrusion, which can be utilized in quickly forming relatively deep closed-ended metal objects such as food and beverage cans and cigar tubes, a blank of material to be extruded is forced into a cavity tool that has a cavity of substantially the same size and shape as the desired outer shape of the extruded object to determine the outer shape thereof. The blank is forced into the cavity of the cavity tool by a core tool that has an outer shape that is substantially the same size and shape as the desired inner surface of the extruded object. The shape and size of the elongated closed-ended tube so formed by impact extrusion is defined by the generally cylindrical gap between the cavity tool and the core tool when the core tool is fully driven into the cavity of the cavity tool, similarly to a mold. The extruded object is removed from the cavity and core tools and is trimmed to the desired length of the extruded object.

Housing 20 formed by impact extrusion is removed from the cavity and core tools and the rearward end thereof is cut to the desired length. The resulting extruded hollow tube is then coated with an insulating coating such as an anodize coating. Thus, a reamer or boring tool of diameter greater than the inner diameter of the reduced inner diameter portion 24 and less than the inner diameter of the remainder of housing 20 will remove the insulating coating only in the reduced inner diameter portion 24 of housing 20, and may include a portion forward of the reamer or boring tool portion for substantially contemporaneously cutting opening 28 in the forward end of housing 20. A housing 20 so formed by thin wall impact extrusion may have a cylindrical outer shape or other outer shape, as is desired.

Alternatively, housing 20 may be formed by boring or drilling an interior bore into a solid piece of material, such as a rod or bar of aluminum or other metal, for example. The drilling or boring of such deep small-diameter holes is usually referred to as "gun boring." The drilling or boring tool can have a smaller-diameter forward portion and a larger-diameter rearward portion so as to drill or bore a hole having a reduced inner diameter forward portion 24, which forward portion 24 may be a cylindrical bore or a tapered bore or other reduced inner diameter bore. Housing 20 is then coated with an insulating coating such as an anodize coating. Thus, a reamer or boring tool of diameter greater than the inner diameter of the reduced inner diameter portion 24 and less than the inner diameter of the remainder of housing 20 will remove the insulating coating only in the reduced inner diameter portion 24 of housing 20, and may include a portion forward of the reamer or boring tool portion for substantially contemporaneously cutting opening 28 in the forward end of housing 20. A housing 20 so formed by gun boring may have a cylindrical outer shape or other outer shape, as is desired.

Flashlight 10 as described provides the advantages of a very small diameter housing 20 and a relatively high intensity light source 110 that has very long useful life, e.g., in excess of 100,000 hours, and operates for a long time, e.g., over 10 hours, on a set of batteries. An additional advantage obtains due to the water resistance provided by O-rings 116, 38 and 214 providing seals between the light source 110 and housing 20, tail cap 40 and housing 20, and pushbutton 210 and tail cap 40, respectively.

While the present invention has been described in terms of the foregoing exemplary embodiments, variations within the scope and spirit of the present invention as defined by the claims following will be apparent to those skilled in the art. For example, a clip may be installed onto housing 20 to provide a simple means for securing flashlight 10 in the pocket of a user's garment or apron or the like. In addition, either or both of housing 20 and tail cap 40 may be knurled to provide a better gripping surface for facilitating the relative rotational movement of housing 20 and tail cap 40 for the turning on and off of flashlight 10.

In addition, protective electrical resistor 130 of light source assembly could be eliminated or could be replaced by another electrical device, e.g., a field-effect transistor current limiter, that would limit the current that could flow through LED light source 110 to a safe level.

What is claimed is:

1. A flashlight comprising:

a cylindrical housing having a reduced inner diameter portion and a hole at a forward end thereof, wherein said housing is electrically conductive, wherein the reduced inner diameter portion defines a shoulder;

a solid state light source in said housing abutting the shoulder and projecting through the hole at the forward end of said housing;

at least one battery in said housing;

a tail cap attached to said housing at a rearward end thereof; and a switch for selectively connecting said solid state light source and said at least one battery in circuit for causing said solid state light source to produce light, said circuit including said electrically conductive housing.

2. The flashlight of claim 1 wherein said housing is coated with an electrically insulating coating, but not at a contact area on an inner surface of the reduced inner diameter portion thereof, and wherein said solid state light source electrically contacts the contact area.

3. The flashlight of claim 2 wherein said housing is aluminum and said coating includes an anodized finish.

4. The flashlight of claim 2 wherein a portion of said electrically-insulating coating is removed to provide said contact area.

5. The flashlight of claim 1 wherein said reduced inner diameter portion includes a tapered portion.

6. The flashlight of claim 1 wherein said housing has an outer diameter of 1 cm or less.

7. The flashlight of claim 1 wherein said at least one battery includes at least one type AAAA alkaline battery.

8. The flashlight of claim 1 wherein said solid state light source includes a light-emitting diode.

9. The flashlight of claim 1 wherein said switch includes a pushbutton switch located in said tail cap for selectively connecting and disconnecting said at least one battery and said housing when said pushbutton is pressed and released.

10. A pocket-sized flashlight comprising:

a one-piece elongated hollow metal housing having a tapered forward end, the tapered forward end of said metal housing defining a cylindrical bore having a reduced innner diameter defining a shoulder and having an axial hole at the forward end thereof, whereby the tapered forward end has a wall of tapering thickness, a solid state light source disposed in the cylindrical bore of the forward end of said metal housing abutting the shoulder, said solid state light source including a light-emitting lens projecting through the axial hole at the forward end of the metal housing, said solid state light source including a first electrical lead making electrical contact to the cylindrical bore of said metal housing and a second electrical lead;

a plurality of batteries in series connection in said metal housing and electrically connected to the second electrical lead of said solid state light source;

a tail cap attached to said metal housing at a rearward end thereof and having a hole therein; and a pushbutton switch located in said tail cap and extending through the hole therein for selectively correcting said plurality of batteries to said metal housing, whereby said solid state light source and said batteries are selectively connected in circuit for causing said solid state light source to selectively produce light responsive to said pushbutton switch.

11. A pocket-sized flashlight comprising:

an elongated hollow cylindrical metal housing having a reduced inner diameter portion and a hole at a forward end thereof, wherein the reduced inner diameter portion defines a shoulder;

a solid state light source located in said housing abutting the shoulder and having a light-emitting lens projecting through the hole at the forward end of the metal housing, said solid state light source having first and second electrical leads, the first electrical lead making electrical contact to said metal housing;

a plurality of batteries in series connection in said housing and connected to the second electrical lead of said solid state light source;

a tail cap attached to said metal housing at a rearward end thereof and having a hole therein; and a pushbutton switch located in said tail cap and extending through the hole therein for selectively connecting said plurality of batteries to said metal housing, whereby said solid state light source and said batteries are selectively connected in circuit for causing said solid state light source to selectively produce light responsive to said pushbutton switch.

12. The pocket-sized flashlight of claim 11 wherein said reduced inner diameter portion includes a tapered portion.

13. The pocket-sized flashlight of claim 11 wherein said metal housing and said tail cap each include threads attaching said tail cap to said metal housing, whereby rotating one of said housing and said tail cap relative to the other one thereof causes said tail cap to move axially in relation to said metal housing; and wherein the relative rotation of said tail cap and said metal housing selectively connects said plurality of batteries to said metal housing.

14. A method of making an elongated hollow housing comprising:

providing an elongated hollow tube of electrically-conductive material;

forming a taper defining a reduced inner diameter portion at one end of the elongated hollow tube;

forming a rounded end at the one end of the elongated hollow tube;

drilling or boring a longitudinal cavity in the reduced inner diameter portion of the tapered one end of the elongated hollow tube; and drilling or boring a circular hole in the rounded end of the tapered one end of the elongated hollow tube.

15. A method of making a housing comprising:

providing an elongated hollow member of electrically conductive material having an insulating coating thereon;

forming a reduced inner diameter portion in the elongated hollow member; and removing the insulating coating from an inner surface of the elongated hollow member in the region of the reduced inner diameter portion thereof.

16. The method of claim 15 wherein said providing an elongated hollow member includes providing an elongated tube of electrically conductive material; and coating the elongated tube with a coating of an insulating material.

17. The method of claim 16 wherein said coating the elongated tube includes applying an anodized finish.

18. The method of claim 16 wherein the elongated tube is aluminum and the insulating material is aluminum anodize.

19. The method of claim 15 wherein the elongated hollow member includes an an elongated tube, and wherein said forming a reduced inner diameter portion includes roll forming a tapered portion in the elongated tube.

20. The method of claim 19 wherein said forming further includes roll forming a rounded end at the end of the tapered portion of the elongated tube.

21. The method of claim 20 further including making a circular opening in the rounded end of the elongated tube.

22. The method of claim 19 wherein said removing the insulating coating includes inserting a cutting tool into the elongated tube to remove the insulating coating from at least part of an inner surface of the tapered portion thereof.

23. The method of claim 22 further including making a circular opening in a rounded end of the elongated tube substantially contemporaneously with said removing the insulating coating.

24. The method of claim 15 wherein said providing an elongated hollow member includes:

providing an elongated piece of electrically conductive material;

one of drilling and boring an elongated longitudinal cavity in the elongated piece; and coating the elongated piece with a coating of an insulating material.

25. The method of claim 24 wherein said forming a reduced inner diameter portion is substantially contemporaneous with said one of drilling and boring an elongated longitudinal cavity.

26. The method of claim 25 wherein said one of drilling and boring utilizes a rotatable tool having a first portion determining the elongated longitudinal cavity and having a second portion forward of the first portion determining the reduced inner diameter portion.

27. The method of claim 15 wherein said providing an elongated hollow member includes:

providing a blank of electrically conductive material;

impact extruding the blank to form the elongated hollow member; and coating the elongated hollow member with a coating of an insulating material.

28. The method of claim 27 wherein said impact extruding utilizes a core tool having a first portion defining an internal cavity of the elongated hollow member.

29. The method of claim 28 wherein said forming a reduced inner diameter portion is substantially contemporaneous with said impact extruding, the core tool having a second portion forward of the first portion thereof determining the reduced inner diameter portion.

30. The method of claim 15 wherein said removing the insulating coating includes inserting a cutting tool into the elongated hollow member to remove the insulating coating from at least part of the inner surface of the reduced inner diameter portion thereof.

31. The method of claim 15 further including knurling an external surface of said elongated hollow member.

32. The method of claim 15 further including removing the insulating coating from an end of said elongated hollow member distal the reduced inner diameter portion thereof.

33. A method of making a housing comprising:

providing an elongated hollow member of electrically conductive material;

forming a reduced inner diameter portion in the elongated hollow member; and drilling or boring a longitudinal cavity in the reduced inner diameter portion of the elongated hollow member.

34. The method of claim 33 wherein said providing an elongated hollow member includes providing an elongated tube of electrically conductive material; and coating the elongated tube with a coating of an insulating material.

35. The method of claim 34 wherein the elongated tube is aluminum and the insulating material is anodize.

36. The method of claim 33 wherein said drilling or boring includes using a rotatable tool having a forward portion for said drilling or boring the longitudinal cavity in the reduced inner diameter portion of the elongated hollow member.

37. The method of claim 33 wherein the elongated hollow member includes an elongated tube, and wherein said forming a reduced inner diameter portion includes roll forming a tapered portion in the elongated tube.

38. The method of claim 37 wherein said forming further includes roll forming a rounded end at the end of the tapered portion of the elongated tube.

39. The method of claim 38 further including making a circular opening in the rounded end of the elongated tube.

40. The method of claim 33 wherein said providing an elongated hollow member includes:

providing an elongated piece of electrically conductive material;

one of drilling and boring an elongated longitudinal cavity in the elongated piece; and coating the elongated piece with a coating of an insulating material.

41. The method of claim 40 wherein said forming a reduced inner diameter portion is substantially contemporaneous with said one of drilling and boring an elongated longitudinal cavity.

42. The method of claim 41 wherein said one of drilling and boring utilizes a rotatable tool having a first portion determining the elongated longitudinal cavity and having a second portion forward of the first portion determining the reduced inner diameter portion.

43. The method of claim 33 wherein said providing an elongated hollow member includes:

providing a blank of electrically conductive material;

impact extruding the blank to form the elongated hollow member; and coating the elongated hollow member with a coating of an insulating material.

44. The method of claim 43 wherein said impact extruding utilizes a core tool having a first portion defining an internal cavity of the elongated hollow member.

45. The method of claim 44 wherein said forming a reduced inner diameter portion is substantially contemporaneous with said impact extruding, the core tool having a second portion forward of the first portion thereof determining the reduced inner diameter portion.

46. The method of claim 33 further including knurling an external surface of said elongated hollow member.

47. A method of making an elongated hollow housing comprising:

providing a blank of electrically conductive material;

impact extruding the blank to form an elongated hollow tube of electrically-conductive material;

said impact extruding utilizing a core tool having a first portion defining an internal cavity of the elongated hollow tube;

forming a reduced inner diameter portion at one end of the elongated hollow tube; and forming a rounded end at the one end of the elongated cylindrical hollow tube.

48. The method of claim 47 further comprising:

drilling or boring a longitudinal cavity in the reduced inner diameter portion of the tapered one end of the elongated cylindrical hollow tube; and drilling or boring a circular hole in the rounded end of the tapered one end of the elongated cylindrical hollow tube.

49. The method of claim 48 wherein said drilling and boring a longitudinal cavity and said drilling or boring a circular hole utilize a rotatable tool having a first portion determining the inner diameter of the longitudinal cavity and having a second portion forward of the first portion determining the circular hole.

50. The method of claim 47 wherein said forming a reduced inner diameter portion is substantially contemporaneous with said impact extruding, the core tool having a second portion forward of the first portion thereof determining the reduced inner diameter portion.

51. A pocket-sized flashlight comprising:

a one-piece elongated hollow cylindrical metal housing having a rearward end and a tapered forward end, the tapered forward end of said cylindrical metal housing defining a longitudinal cylindrical bore having a reduced inner diameter defining a shoulder and having an axial hole at the forward end thereof, whereby the tapered forward end has a wall of tapering thickness, a solid state light source disposed in the cylindrical bore of the forward end of said cylindrical metal housing abutting the shoulder, said solid state light source including a light-emitting diode having a lens projecting through the axial hole at the forward end of the cylindrical metal housing, said solid state light source including an insulating member disposed rearward of said light-emitting diode and having a central cavity, said solid state light source including a first electrical lead making electrical contact to the cylindrical bore of said cylindrical metal housing, said solid state light source including a second electrical lead extending through the central cavity of said insulating member;

a plurality of cylindrical batteries in series connection in said cylindrical metal housing and electrically contacting the second electrical lead of said solid state light source;

a tail cap attached to said cylindrical metal housing at the rearward end thereof and having a hole therein;

a switch having a pushbutton extending through the hole in said tail cap for selectively making an electrical connection between said plurality of batteries and said cylindrical metal housing, whereby said solid state light source and said batteries are selectively connected in circuit for causing said light-emitting diode to selectively produce light responsive to said pushbutton switch.

* * * * *